United States Patent [19]

Gonzales

[11] 4,374,788

[45] Feb. 22, 1983

[54] PROCESS FOR TREATMENT OF OLEFIN POLYMER FIBRILS

[75] Inventor: William H. Gonzales, Houston, Tex.

[73] Assignee: Gulf Oil Corporation, Pittsburgh, Pa.

[21] Appl. No.: 16,239

[22] Filed: Feb. 28, 1979

[51] Int. Cl.[3] ..... B29C 23/00

[52] U.S. Cl. ..... 264/5; 162/157 R; 264/8

[58] Field of Search ..... 162/146, 157 R, 182, 162/168 R; 260/897 B, 29.6 WA, 29.6 XA; 264/140, 5, 8

[56] References Cited

U.S. PATENT DOCUMENTS

| | | | |
|---|---|---|---|
| 3,920,507 | 11/1975 | Yonemori | 162/157 R |
| 4,013,751 | 3/1977 | Davis et al. | 162/157 R |
| 4,049,492 | 9/1977 | Lare | 162/157 R |
| 4,134,931 | 1/1979 | Hayes, Jr. et al. | 162/157 R |
| 4,152,317 | 5/1979 | Agouri et al. | 162/157 R |

*Primary Examiner*—Peter Chin

*Attorney, Agent, or Firm*—Richard L. Kelly

[57] ABSTRACT

Fibrils prepared by a differential temperature precipitation process of the type described in U.S. Pat. No. 4,013,751 are refined in isopropanol at a subambient temperature not higher than about 10° C., and subsequently are treated with an aqueous solution of polyvinyl alcohol to sorb at least 1.0 weight % of polyvinyl alcohol on the fibrils. The treated fibrils, as compared with fibrils prepared by prior art processes disperse more readily in aqueous media and provide water-laid sheets having greater strength. The fibrils preferably are prepared from an olefin polymer having a weight average molecular weight of at least one (1) million.

9 Claims, No Drawings

PROCESS FOR TREATMENT OF OLEFIN POLYMER FIBRILS

BACKGROUND OF THE INVENTION

Olefin polymer fibrils constitute a known class of fiber-like materials that are prepared by precipitating an olefin polymer from a solution thereof under conditions of high shear. See for example U.S. Pat. No. 4,013,751. Frequently the olefin polymer fibrils are refined with a polar organic liquid such as isopropanol and then treated with an aqueous solution of polyvinyl alcohol, with both treatment steps being carried out at ambient temperature, e.g., 20° C., or a somewhat elevated temperature. This process, which is disclosed in U.S. Pat. Nos. 4,049,492 and 4,049,493, improves the fibrils' properties by a mechanism which has not been ascertained.

SUMMARY OF THE INVENTION

The applicant has discovered that the properties of olefin polymer fibrils* can be further improved if freshly prepared fibrils are refined with a polar organic liquid such as isopropanol at a subambient temperature not higher than about 10° C. before the fibrils are treated with the polyvinyl alcohol solution. Fibrils prepared by the method of the present invention disperse more readily in aqueous media than do fibrils treated under otherwise identical conditions, but refined at higher temperatures such as 20° C. or higher.

*Hereinafter, for brevity of expression, the olefin polymer fibrils frequently will be referred to simply as "fibrils."

DETAILED DESCRIPTION OF THE INVENTION

The fibrils employed in the practice of the invention can be prepared by any of the methods reported in the art. Preferably, the fibrils are prepared by a differential temperature precipitation process. The olefin polymer is dissolved in a suitable solvent such as a hydrocarbon or a halogenated hydrocarbon. The polymer concentration is set at the highest feasible level consistent with (a) maintaining a solution viscosity that can be handled in the process, and (b) producing fibrils having good properties. The level of polymer concentration that can be employed will be somewhat dependent upon the molecular weight of the olefin polymer. It is possible to employ solutions containing at least 1 and sometimes up to about 10 parts of olefin polymer per 100 parts of solvent. The fibrils are prepared by subjecting the hot polymer solution to high shearing forces to orient the solute polymer molecules in the solvent and immediately thereafter cooling the solution to precipitate fibrils therefrom. Several methods for preparing fibrils by this method are reported in the art, including U.S. Pat. Nos. 4,013,751; 4,125,584; the copending application of R. E. Boehme et al, Ser. No. 892,799,* filed Apr. 3, 1978; and the copending application of Kim et al, Ser. No. 937,353,* filed Aug. 28, 1978, the description of each of which are incorporated herein by reference. Fibrils prepared by the process described in the Kim et al application show greater improvements in properties when treated by the process of the present invention than do fibrils prepared by alternate manufacturing processes.

*Each of these pending applications is assigned to the assignee of this application.

To prepare treated fibrils having optimum physical properties, the fibrils should be prepared from an olefin polymer having a weight average molecular weight of at least 1 million and preferably at least 1.5 million. The preferred species of olefin polymer for use in the preparation of the fibrils is an ethylene polymer containing, on a weight basis, at least 90% of polymerized ethylene. Such ethylene polymers will be ethylene homopolymer or ethylene copolymers containing small quantities of a $C_4$ or higher olefin comonomer such as butene, hexene, styrene, a conjugated diene such as butadiene, or the like. A second species of suitable olefin polymers consists of propylene polymers consisting, on a weight basis, at least 50% of polymerized propylene. Such propylene polymers will be propylene homopolymers, or propylene copolymers containing up to 50% of copolymerized ethylene. A further listing of suitable olefin polymers, including polymer mixtures containing olefin polymers, suitable for use in the invention, is set forth in U.S. Pat. No. 4,013,751, which description is incorporated herein by reference.

The fibrils, after being prepared as described above, are refined in a low molecular weight oxygen containing liquid at a subambient temperature not higher than about 10° C. It is noted that the ultimate fibril properties continue to show improvement as the refining temperature is lowered to temperatures as low as about −20° C. The oxygen containing liquid refining medium can be an alcohol such as methanol or ethanol, a polyhydric compound such as ethylene glycol, propylene glycol, or glycerine, or a ketone such as acetone. A propanol such as n-propanol and especially isopropanol is the preferred compound for use as the refining medium. The refining step can be carried out in conventional refining equipment such as Waring Blendors, disc mills, and the like.

The fibrils, after being refined as described above, are treated with a solution of polyvinyl alcohol (PVA) under high shearing forces to sorb at least about 1.0 weight %, and preferably at least about 4.0 weight % of polyvinyl alcohol on the fibrils. The precise manner in which the PVA becomes associated with the fibrils has not been established. In this application the term "sorb" will be used to denote this association. The percent of PVA sorbed can be established by pressing the treated fibrils into a film and determining the PVA content by infra-red analysis. Alternatively, the PVA content can be determined by acetylating the PVA with acetic anhydride in pyridine, followed by titration of the acetic acid produced. This method is reported at *Analytical Chemistry of Polymers, Part I,* Gordon Kline, ed., Interscience Publishers, N.Y., 1959, p. 481.

While the refined fibrils can be treated with the PVA solution at ambient temperature, it is preferred to carry out this treatment at a subambient temperature not higher than about 10° C. Where the treatment is carried out above 0° C., the PVA will be dissolved in water. If the treatment is carried out at a temperature significantly below 0° C., it may be necessary to include a water soluble organic liquid such as isopropanol in the water to prevent freezing of the solution.

The PVA is sorbed on the fibrils by suspending the refined fibrils in the PVA solution and subjecting the suspension to high shearing forces. On a laboratory scale, the treatment is conveniently effected in a Waring Blendor. On a larger scale, the treatment can be effected in a disc mill or like refiner with the clearance being set to provide high shear on the suspension. Another means for effecting the treatment is to stir the suspension of fibrils in the PVA solution while subjecting the suspension to ultrasonic vibrations. This method of treatment is described in U.S. Pat. No. 4,134,931, which description is incorporated herein by reference.

The polyvinyl alcohol solution employed will have dissolved therein about 2–15 and preferably about 4–10 weight % of the polymer. The weight ratio of fibrils to polyvinyl alcohol solution employed will be such that a minimum of 1 and preferably at least 10 parts of polyvinyl alcohol are present per 100 parts of the fibrils. The treatment can be carried out in a single step, or in multiple steps in which the fibrils are treated with fresh aliquots of the PVA solution. In all cases, the treatment will be such to sorb the minimum percent of PVA as previously set forth. The grade of polyvinyl alcohol employed in the process is not critical. Vinol 540 sold by Air Products and Chemicals provides satisfactory results.

The fibrils prepared by the method of the present invention differ from fibrils prepared under otherwise identical conditions, but refined at ambient temperature or above, in two (2) important respects. First, the fibrils are more hydrophilic and disperse more readily in aqueous media. Thus, paper making furnishes of the fibrils are more easily prepared. The fibrils can be more uniformly dispersed in furnishes of cellulosic pulps when it is desired to prepare water-laid sheets from mixtures of cellulose pulp and fibrils. Second, water-laid sheets prepared from the fibrils have greater strength properties.

The following examples are set forth to illustrate more clearly the principle and practice of the invention to those skilled in the art. Where parts or percentages are set forth, they are parts or percentages by weight unless otherwise indicated. All reported paper properties were obtained using TAPPI procedures and values are reported on a factored basis, i.e., the measured value is divided by the basis weight of the sheet.

EXAMPLE 1

Part A

Fibrils were prepared by the process described in the pending Kim et al application, Ser. No. 937,353, filed Aug. 28, 1978, by injecting a 2 weight % solution of an ethylene homopolymer (weight average molecular weight of about 1.5 million) dissolved in cyclohexane from a high temperature, high pressure zone (pressure of about 34 atmospheres—temperature about 150° C.) into a stirred bath of isopropanol maintained at atmospheric pressure and a temperature of about 4° C. The fibrils were recovered by filtration.

Part B

An aliquot of the fibrils of Part A was refined by the method of the present invention by refining the fibrils in a Waring Blendor as a 1.0% slurry of fibrils in isopropanol that had been chilled to about 4° C. The fibrils then were treated in a Waring Blendor with a 1.0% aqueous solution of polyvinyl alcohol (PVA) to sorb about 2 weight % PVA on the fibrils. The PVA solution was maintained at about 4° C. during this treatment step.

Part C

As a control representative of a prior art process, another aliquot of the fibrils prepared in Part A was refined in the same manner as described in Part B, except that the fibrils were refined in isopropanol at ambient temperature of about 20° C. The treatment of the fibrils in the PVA solution also was carried out at ambient temperature of about 20° C.

Part D

Water-laid sheets of the fibrils prepared in Parts B and C were prepared on a Noble & Wood sheet machine. The tear factor and the tensile factor were measured and are set forth in Table I.

TABLE I

| Sample | Part B | Part C (Control) |
|---|---|---|
| Tear, g/sheet | 228 | 233 |
| Tensile, lb/sheet | 30 | 10 |

It will be observed that the product of the invention (Part B), as compared with the prior art control (Part C), has a significantly higher tensile and an equivalent tear factor.

EXAMPLE 2

Another lot of fibrils was prepared by the process described in the pending Kim et al application, Ser. No. 937,353, filed Aug. 28, 1978, by injecting a 2 weight % solution of an ethylene homopolymer (weight average molecular weight of about 1.5 million) dissolved in methylene chloride from a high temperature, high pressure zone (pressure of about 33 atmospheres—temperature about 150° C.) into a stirred bath of isopropanol maintained at atmospheric pressure and a temperature of about 4° C. The fibrils then were refined in cold isopropanol and subsequently treated in a cold PVA solution under the same condition set forth in Example 1, Part B. Hand sheets prepared from these fibrils had a tear factor of 343 g/sheet and a tensile factor of 50 lb/sheet.

EXAMPLE 3

A 1% aqueous paper making furnish was prepared from a mixture containing 95 weight % of an unbleached Kraft pulp and 5 weight % of the fibrils from Example 1, Part B. As a control, a similar furnish was prepared from a mixture containing 95 weight % of the same unbleached Kraft pulp and 5 weight % of the prior art fibrils of Example 1, Part C. The two furnishes were refined to an equivalent degree and hand sheets were prepared therefrom. The sheet prepared from the furnish containing the fibrils of the invention, when viewed visually in strong light, had a homogeneous appearance indicating that the fibrils were uniformly dispersed and intermeshed with the cellulose fibers. By contrast, the sheet prepared from the furnish containing the prior art fibrils was heterogeneous in appearance with numerous white fibrils being readily visible. The appearance of the two sheets clearly indicated that the fibrils of the invention disperse much more readily in an aqueous medium.

The commonly assigned application of Clarence R. Murphy et al, Ser. No. 16,060, filed Feb. 28, 1979, discloses improved paper products prepared from furnishes containing at least 90 weight % of cellulosic paper making fibers and up to 10 weight % of certain PVA treated fibrils. The paper products of that application can be improved by employing the fibrils of this application for the fibrils disclosed in the Murphy et al application.

What is claimed is:

1. In a process in which olefin polymer fibrils are prepared by:

a. Cooling a hot olefin polymer solution under conditions of high shear to prepare fibrils, b. Recovering the precipitated fibrils, c. Refining the fibrils in the presence of a low molecular weight oxygen containing liquid, and d. Treating the fibrils with an aqueous solution of polyvinyl alcohol to sorb at least 1 weight % of polyvinyl alcohol on the fibrils, the improvement which consists of carrying out the refining step (c) at a subambient temperature not higher than about 10° C.

2. The process of claim 1 in which the refining step (c) is carried out at a temperature in the range of about −20° C. to about 10° C.

3. The process of claim 2 in which the step (d) of treating the refined fibrils with a solution of polyvinyl alcohol also is carried out at a subambient temperature not higher than about 10° C.

4. A process of claim 1 in which the low molecular weight oxygen containing liquid employed in step (c) is n-propanol or isopropanol.

5. A process of claim 2 in which the low molecular weight oxygen containing liquid employed in step (c) is n-propanol or isopropanol.

6. A process of claim 3 in which the low molecular weight oxygen containing liquid employed in step (c) is n-propanol or isopropanol.

7. A process of claim 1 in which the low molecular weight oxygen containing liquid employed in step (c) is isopropanol.

8. A process of claim 2 in which the low molecular weight oxygen containing liquid employed in step (c) is isopropanol.

9. A process of claim 3 in which the low molecular weight oxygen containing liquid employed in step (c) is isopropanol.

* * * * *